US009206968B2

(12) United States Patent
Highbridge

(10) Patent No.: US 9,206,968 B2
(45) Date of Patent: Dec. 8, 2015

(54) RECESSED LIGHT FIXTURE WITH TWO-AXIS ROTATIONAL ARM

(71) Applicant: RAB Lighting Inc., Northvale, NJ (US)

(72) Inventor: Doug Highbridge, Hopewell Junction, NY (US)

(73) Assignee: RAB Lighting Inc., Northvale, NJ (US)

( * ) Notice: Subject to any disclaimer, the term of this patent is extended or adjusted under 35 U.S.C. 154(b) by 71 days.

(21) Appl. No.: 14/246,671

(22) Filed: Apr. 7, 2014

(65) Prior Publication Data

US 2014/0307445 A1 Oct. 16, 2014

Related U.S. Application Data

(60) Provisional application No. 61/810,901, filed on Apr. 11, 2013.

(51) Int. Cl.

| | |
|---|---|
| ***F21V 17/00*** | (2006.01) |
| ***F21V 23/00*** | (2015.01) |
| ***F21V 21/04*** | (2006.01) |
| *F21S 8/02* | (2006.01) |
| *F21Y 101/02* | (2006.01) |
| *F21V 29/507* | (2015.01) |
| *F21V 29/74* | (2015.01) |

(52) U.S. Cl.
CPC ..... *F21V 23/008* (2013.01); *F21V 21/042* (2013.01); *F21S 8/026* (2013.01); *F21V 29/507* (2015.01); *F21V 29/74* (2015.01); *F21Y 2101/02* (2013.01)

(58) Field of Classification Search
CPC ..... F21S 8/02; F21S 8/026; F21V 21/26; F21V 15/01; F21V 21/107; F21V 21/04; F21V 21/14; F21V 21/048; F21V 21/30; F21V 23/02; F21Y 2101/02; F21Y 2103/00; F21Y 2103/003
USPC ..... 362/145–148, 249.01, 249.02, 249.1, 362/269, 277, 287, 310, 328, 329, 364, 365, 362/366, 368, 370–372
See application file for complete search history.

(56) References Cited

U.S. PATENT DOCUMENTS

| | | | | |
|---|---|---|---|---|
| 3,293,428 | A | 12/1966 | Herman | |
| 5,130,914 | A | 7/1992 | Bengochea | |
| 6,364,510 | B1 | 4/2002 | Bernhart et al. | |
| 6,461,016 | B1 | 10/2002 | Jamison et al. | |
| 6,779,910 | B1 * | 8/2004 | Pelton | 362/364 |
| 8,070,328 | B1 | 12/2011 | Knoble et al. | |
| 8,506,134 | B2 * | 8/2013 | Wilson et al. | 362/366 |
| 2003/0223240 | A1 | 12/2003 | Houle | |
| 2006/0193142 | A1 | 8/2006 | Dupre | |
| 2010/0149822 | A1 | 6/2010 | Cogliano et al. | |
| 2010/0165643 | A1 | 7/2010 | Russo et al. | |

* cited by examiner

FOREIGN PATENT DOCUMENTS

| | | |
|---|---|---|
| CA | 2661390 | 9/2010 |
| GB | 810255 | 3/1959 |
| JP | 2009230916 | 10/2009 |

*Primary Examiner* — Hargobind S Sawhney
(74) *Attorney, Agent, or Firm* — SmithAmundsen LLC; Kelly J. Smith; Dennis S. Schell

(57) ABSTRACT

An illustrative embodiment of a light fixture, which may be a type of recessed downlight called a wallwasher, includes a light housing and has a power supply, such as a driver and/or electrical junction box, mounted on or forming an arm. The arm is rotationally coupled to the light housing, with the arm having two axes of rotation relative to the light housing. That is, the arm freely rotates laterally about a first axis, and freely rotates in elevation about a second axis.

16 Claims, 8 Drawing Sheets

RECESSED LIGHT FIXTURE WITH TWO-AXIS ROTATIONAL ARM

RELATION TO OTHER PATENT APPLICATION

This application claims priority to provisional patent application 61/810,901, filed Apr. 11, 2013, with the same title.

TECHNICAL FIELD

The present invention relates to recessed light fixtures, and more particularly to providing a recessed light fixture having an arm accommodating tight ceiling spaces.

BACKGROUND

Retrofit or remodel recessed light fixtures are often installed in a small spatial envelope in the ceiling. That is, these light fixtures are often installed in the limited space above a ceiling, such as, for example, between a lower ceiling structure and an upper ceiling structure. Certain light fixtures, such as recessed downlights having drivers and/or junction boxes mounted on the top or upper end of the light housing, may simply not fit in the vertical space available between the lower and upper ceiling structures. Additionally, recessed downlights having drivers and/or junction boxes forming an arm off to one side of the light housing may present difficulties during installation due to the limited depth and/or due to limited lateral space between joists and/or other obstacles located off to the side of the recessed light installation hole. Further, if the recessed downlight is a directional light, such as a wallwasher, the orientation of the light housing is critical and the light housing cannot be rotated to avoid the obstacle.

Therefore, there is a continuing need for light fixtures having versatile and adaptable structures for accommodating various installation configurations. The present disclosure is directed to such an effort.

SUMMARY OF THE DISCLOSURE

The present invention may comprise one or more of the features recited in the attached claims, and/or one or more of the following features and combinations thereof.

An illustrative embodiment of a light fixture, which may be a type of recessed downlight called a wallwasher, includes a light housing and has a power supply, such as a driver and/or electrical junction box, mounted on or forming an arm. The arm is rotationally coupled to the light housing, with the arm having two axes of rotation relative to the light housing. That is, the arm freely rotates laterally about a first axis, and freely rotates in elevation about a second axis.

Additional features of the disclosure will become apparent to those skilled in the art upon consideration of the following detailed description of the illustrative embodiment.

BRIEF DESCRIPTION OF THE DRAWINGS

The detailed description particularly refers to the accompanying figures in which.

DETAILED DESCRIPTION

Figure 1:
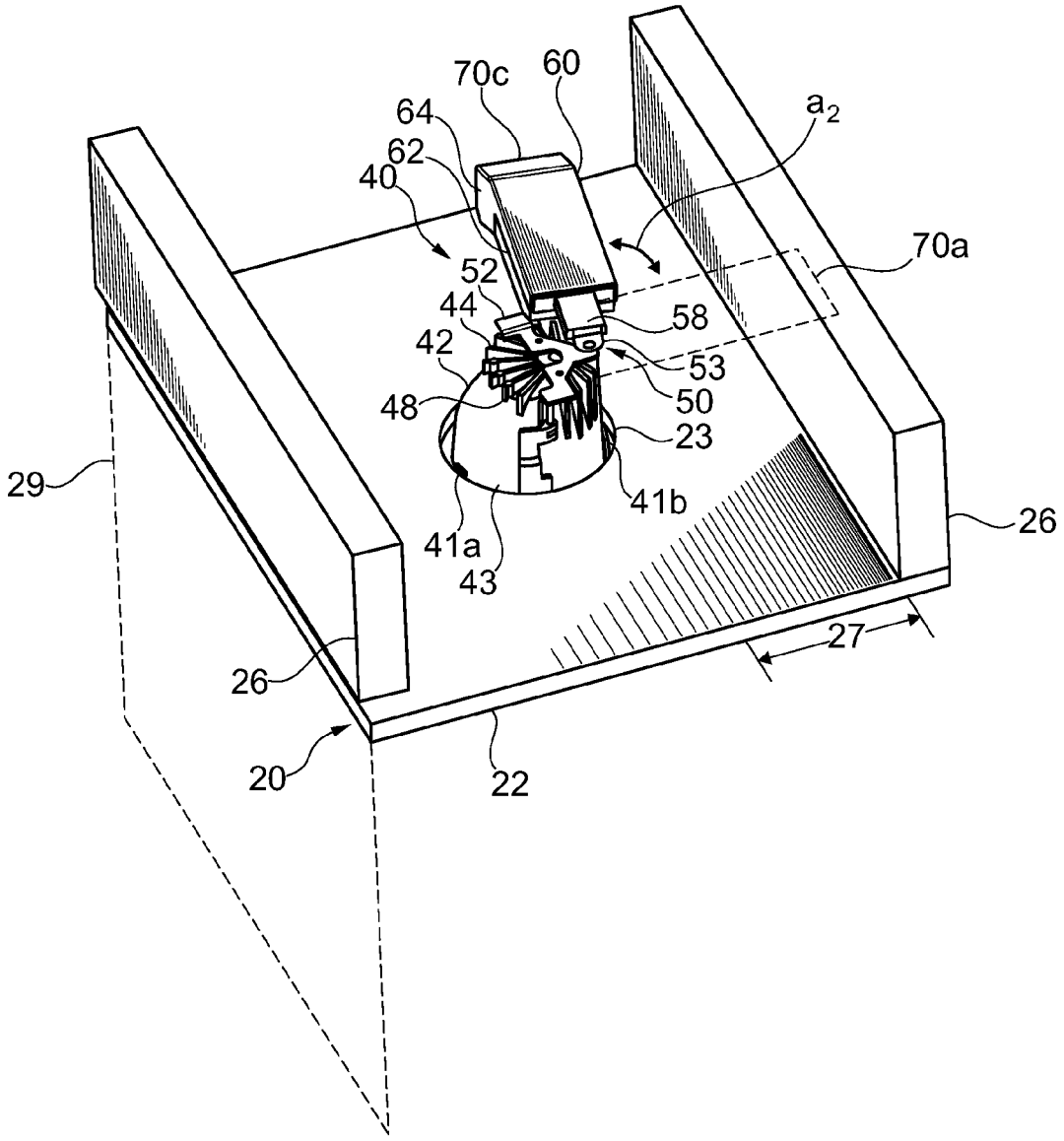
FIG. 1 is a top perspective view of a first embodiment of a light fixture mounted in a ceiling, according to the present disclosure.

For the purposes of promoting and understanding the principals of the disclosure, reference will now be made to one or more exemplary embodiments illustrated in the drawings and specific language will be used to describe the same.

Figure 2:
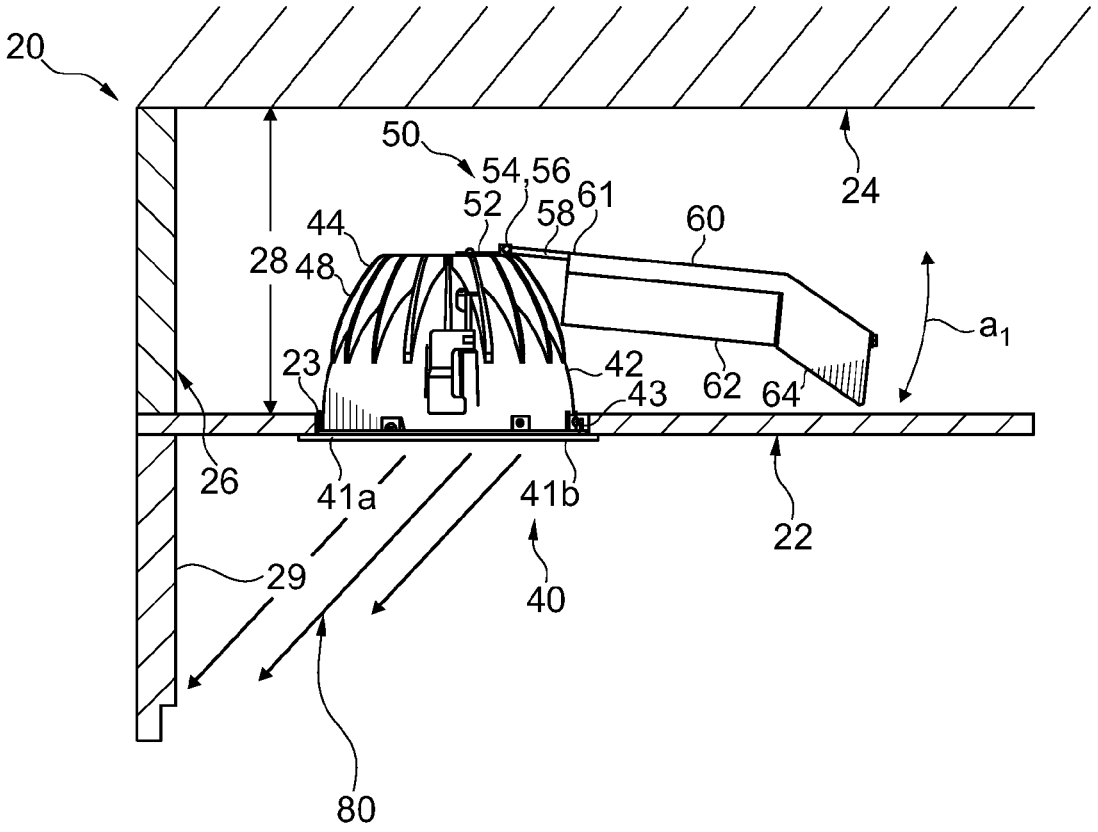
FIG. 2 is a side view of the light fixture of FIG. 1, shown mounted in the ceiling.
Figure 7:
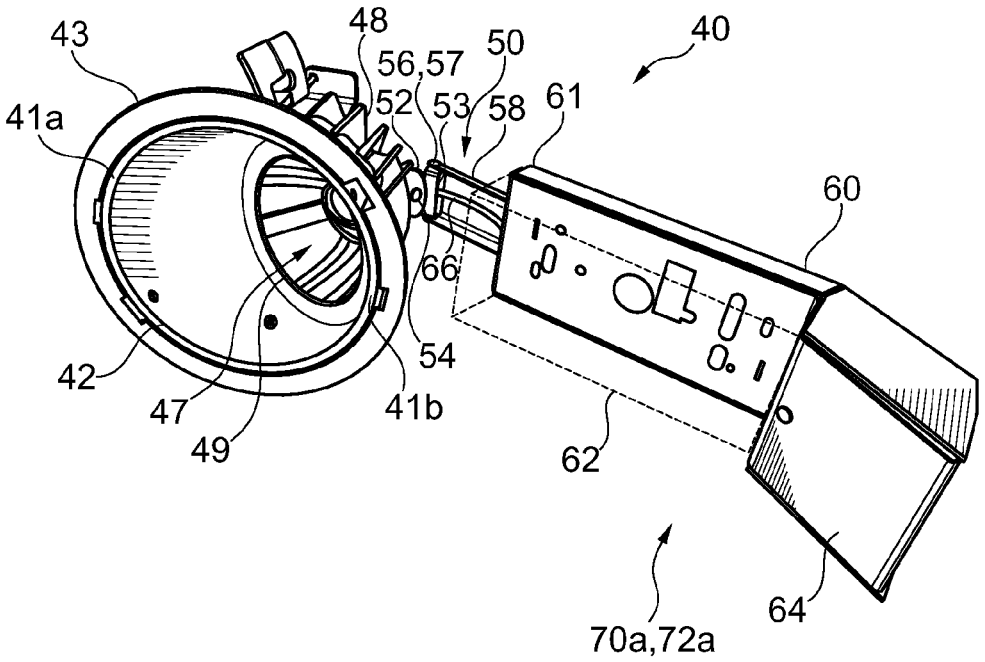
FIG. 7 is a bottom perspective view of the light fixture of FIG. 1, illustrating the arm in the first lateral position and the first elevational position.

Referring to FIGS. 1 and 2, a first illustrative embodiment of a light fixture 40 according to the present disclosure is shown installed with respect to an exemplary ceiling 20. The light fixture 40 generally includes a light housing 42, a rotational coupling 50, and an arm 60. The light housing 42 may house or include a light source 47 (FIG. 7), such as one or more light emitting diode (LED) emitters, a reflector 49 (FIG. 7), a lens, cooling features 48, and any additional or alternative light fixture components known to those skilled in the art.

The arm 60 may include and/or support a power supply for the light source. That is, the arm 60 may include and/or support one or both of a driver 62, for example an LED driver for regulating power to one or more LEDs, and an electrical junction box 64 containing electrical connections, and may include additional and/or alternative features for supplying electrical power to the light fixture 40 in a known manner. As shown in the illustrative embodiment, the arm 60 may extend from an upper end 44 of the light housing 42; however, the arm 60 could alternatively extend from a lower end 43 of the light housing 42 or from some point in between the upper end 44 and the lower end 43. The arm 60 may be of any suitable size and shape, and may be made from any of a variety of materials deemed suitable for the particular application.

Although various light fixtures may utilize the teachings of the present disclosure, the illustrative embodiment of the light fixture 40 is a downlight or, more specifically, a wallwasher type of recessed light, meaning that downward directed light 80 produced by the light source 47 (FIG. 7), for example an LED, and directed by the reflector 49 (FIG. 7) is directed toward a first side 41*a* of the light housing 42, for example, so that it will illuminate a wall 29 located adjacent an installation hole 23 for the light fixture 40. In the illustrative embodiment of the light fixture 40, the arm 60 extends from a second side 41*b* of the light housing 42, opposite the first side 41*a* toward which the light 80 is directed.

Advantageously, the rotational coupling 50 that rotationally couples the light housing 42 with the arm 60 so that the arm 60 can articulate relative to the light housing 42 includes at least one of a lateral pivot 54 and an elevational pivot 56. The elevational pivot 56 may permit elevational rotation of the arm 60, such as elevational rotation of the arm 60 from a first elevational position 72*a* shown in FIG. 3 (and also shown in FIGS. 1 and 2) to a second elevational position 72*b* shown in FIG. 4. Elevational rotation may be advantageous in installation of the light fixture 40, particularly when used for retrofitting or remodeling, especially in a minimally sized installation hole 23 and with minimal clearance depth 28 (FIG. 2) between a lower ceiling structure 22 and an upper ceiling structure 24 of the ceiling 20. The arm 60 articulating in elevation, as indicated by arrow $a_1$ of FIG. 2, allows the arm portion of the light fixture 40 to be extended within tight spaces since it articulates in elevation relative to the light housing 42. For example, the arm 60 may be rotated upward to the second elevational position 72*b* shown in FIG. 4 such that the light fixture 40 occupies a more compact footprint for installation.

Figure 3:
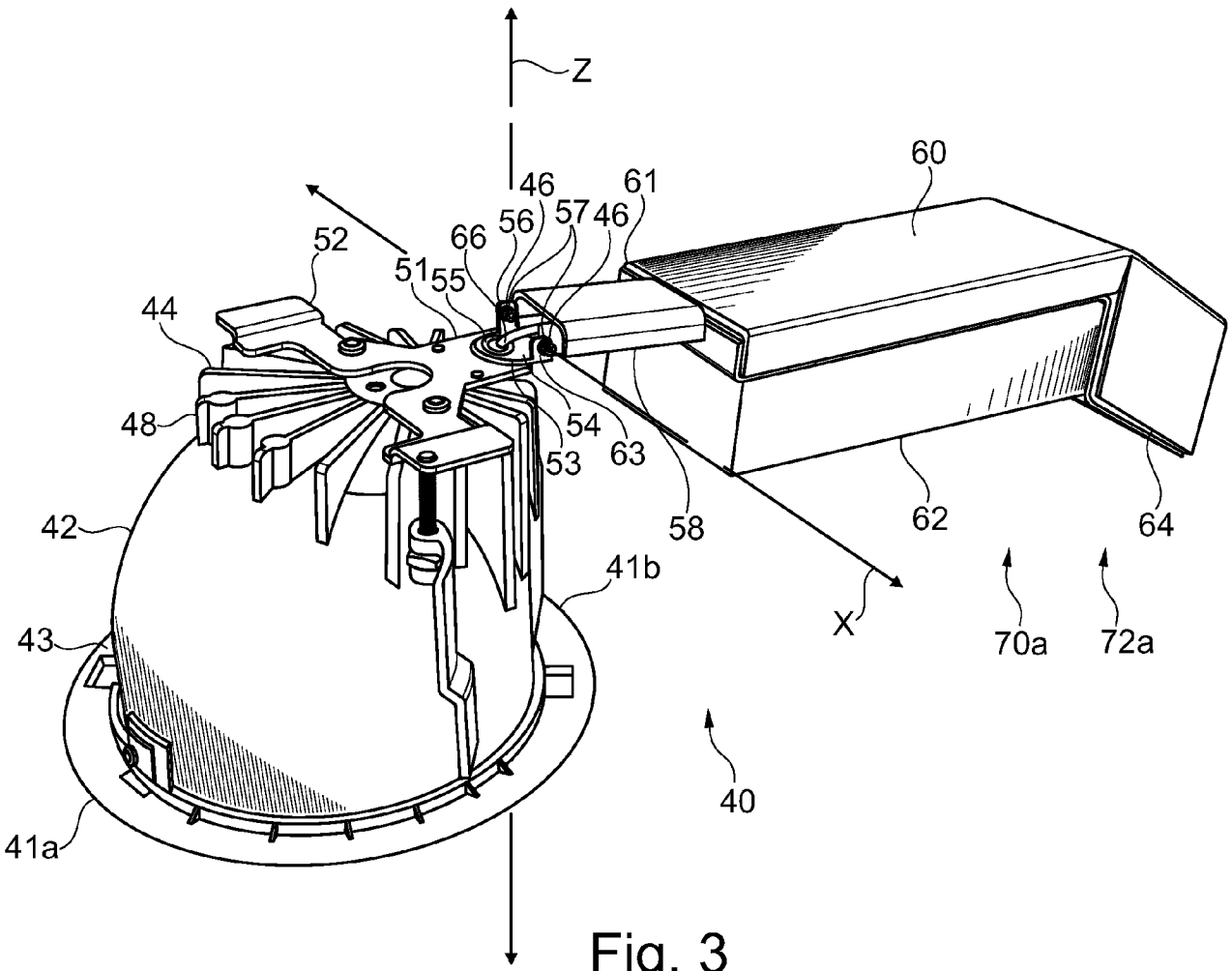
FIG. 3 is a side perspective view of the light fixture of FIG. 1, illustrating the arm in a first lateral position and a first elevational position.
Figure 4:
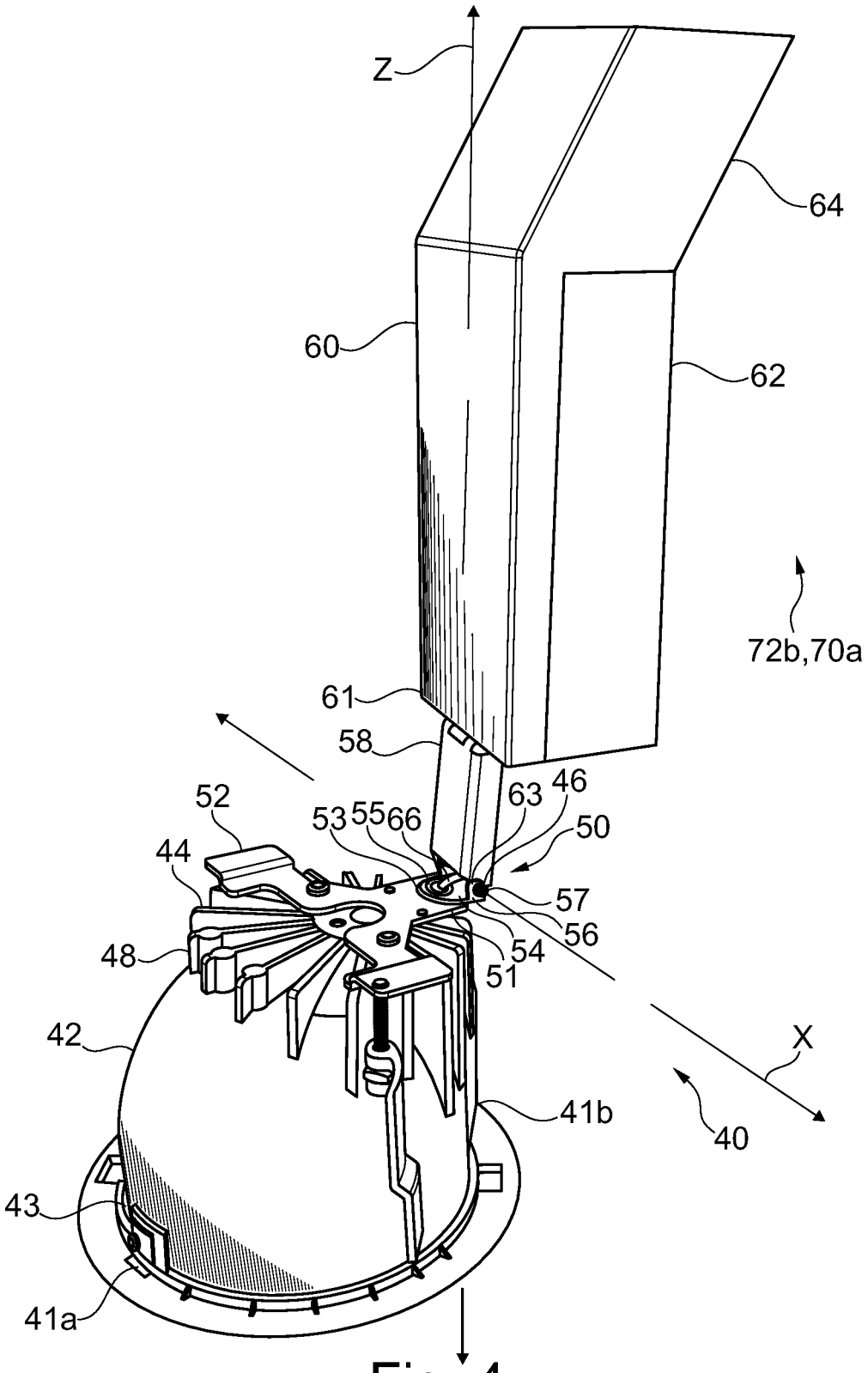
FIG. 4 is a side perspective view of the light fixture of FIG. 1, illustrating the arm in the first lateral position and a second elevational position.

The lateral pivot 54 may permit lateral rotation of the arm 60, such as lateral rotation of the arm 60 from a first lateral position 70*a*, as shown in FIG. 3, to a third lateral position 70*c* shown in FIG. 1. Lateral, or side-to-side, rotation, as indicated by arrow $a_2$ of FIG. 1, may be advantageous in installation of the light fixture 40, particularly when used for retrofitting or remodeling, especially in a minimally sized installation hole 23 and with minimal lateral clearance 27 (FIG. 1) between the installation hole 23 defined through the lower ceiling structure 22 and obstacles, such as, for example, joists 26. As shown in FIG. 1, the minimal lateral clearance 27 prevents the arm 60 from residing in the first lateral position 70*a* (shown in phantom). However, pivoting the arm 60 sideways to the third lateral position 70*c* avoids the joists 26 while maintaining the depicted orientation of the light housing 42. As should be appreciated, if the light fixture 40 is a recessed downlight, such as a wallwasher, the orientation of the light housing 42 is critical and should not be rotated to avoid obstacles.

Referring generally to FIGS. 3 through 7, and according to the illustrative embodiment of the light fixture 40, the rotational coupling 50 that provides the lateral pivot 54 and the elevational pivot 56 may generally include a bracket 52, a coupler 53, and a tongue 58. The bracket 52 may be coupled, or attached, directly to the light housing 42 using fasteners or the like and, according to the exemplary embodiment, may be coupled to the upper end 44 of the light housing 42. According to the depicted light housing 42, the bracket 52 may be coupled directly to, and in direct contact with, cooling features 48 or, more specifically, heat exchange fins extending from the upper end 44 of the light housing 42. A coupling portion 51 of the bracket 52 may extend over the second side 41*b* of the upper end 44 of the light housing 42, as shown.

The tongue 58 may be directly coupled to, or even integral with, the arm 60. In some embodiments, the tongue 58 may directly contact the arm. According to the exemplary embodiment, the tongue 58 may extend from a proximate end 61 of the arm 60. According to some embodiments, the tongue 58 may be shaped or configured to receive or house a length of electrical wire 66 extending from the arm 60 to the light housing 42. More specifically, and as should be appreciated, the electrical wire 66 may electrically interconnect the driver 62 with the light source 47. The exemplary rotational coupling 50 also includes the coupler 53, which rotationally couples the bracket 52 and the tongue 58. Thus, the bracket 52 (and light housing 42) and the tongue 58 (and arm 60) are indirectly coupled together using the coupler 53.

The elevational pivot 56 of the rotational coupling 50 may be defined, at least in part, by a hinge 57 at the interface between the coupler 53 and the tongue 58, which includes rotationally free rivets 46 coupling together ears 63 of the coupler 53 with the tongue 58. For example, corresponding openings through the ears 63 and the tongue 58 may be aligned with rivets 46 passing therethrough to secure the rotational, or pivotable, connection. In FIG. 3 the arm 60 is shown in the first elevational position 72*a* and in FIG. 4 the arm 60 is shown in the second elevational position 72*b*, for example, rotated upward about 90 degrees about the X-axis from that of the first elevational position 72*a*. This second elevational position 72*b* may also be referred to as an installation configuration of the light fixture 40. Although a specific arrangement is shown, it is contemplated that one or more alternative mechanical structures and/or fasteners may be used to couple the arm 60 and the light housing 42, while also permitting the relative movement described herein.

Figure 5:
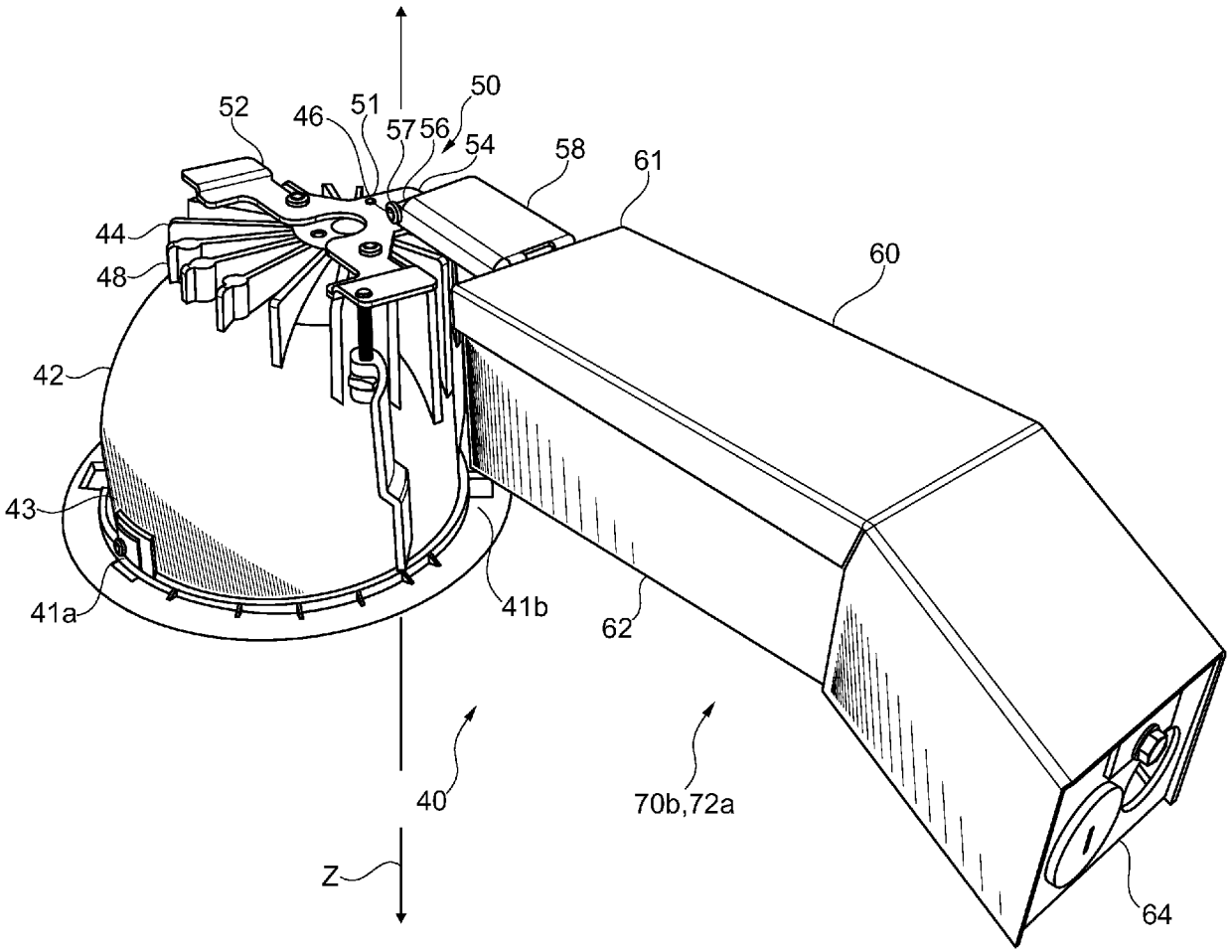
FIG. 5 is a side perspective view of the light fixture of FIG. 1, illustrating the arm in a second lateral position and the first elevational position.
Figure 6:
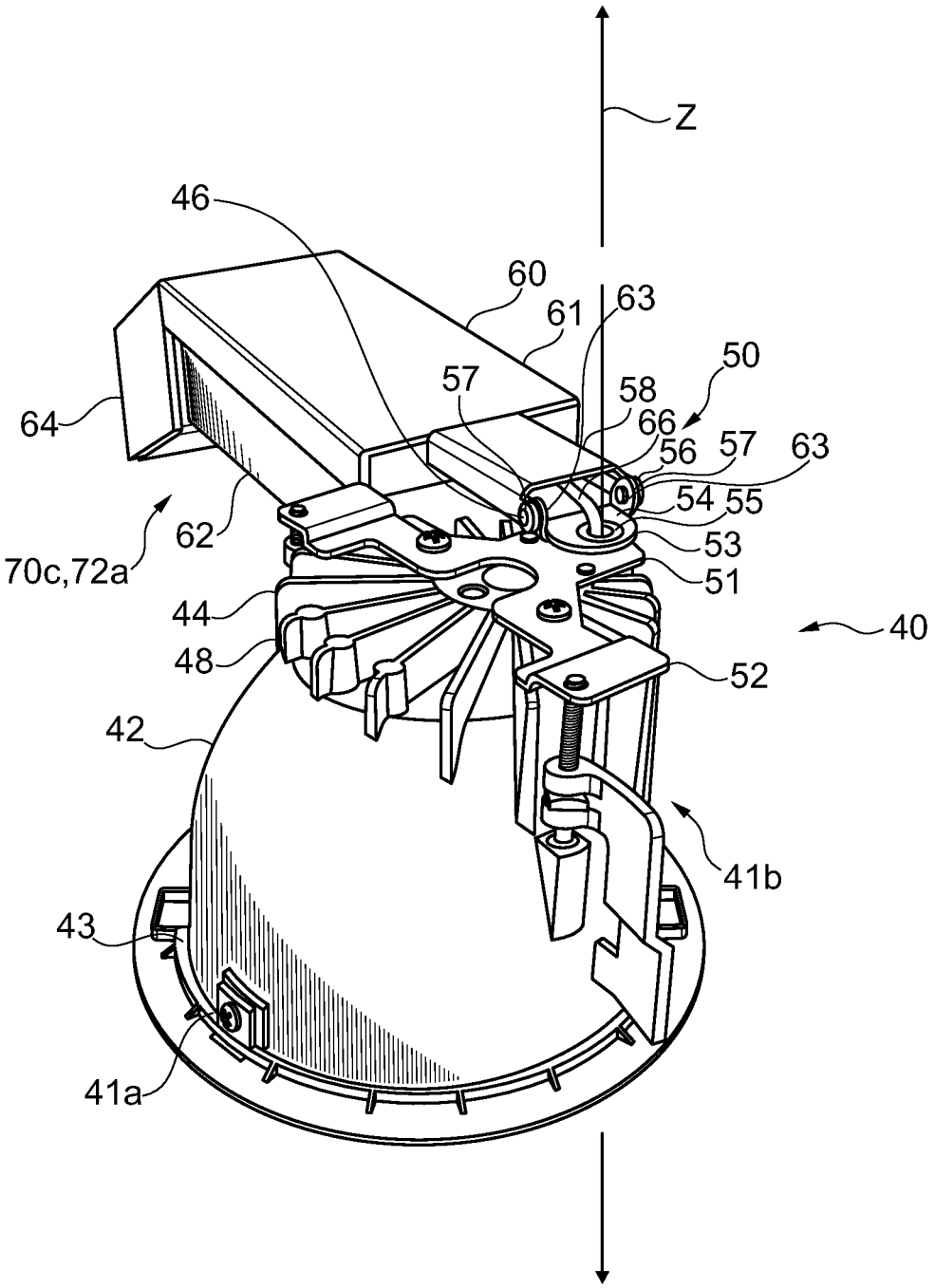
FIG. 6 is a side perspective view of the light fixture of FIG. 1, illustrating the arm in a third lateral position and the first elevational position.

The lateral pivot 54 of the rotational coupling 50 may be defined, at least in part, by a rotationally free eyelet 55 at the interface between the coupler 53 and the bracket 52. For example, the lateral pivot 54 may include aligned openings of the coupler 53 and the bracket 52, which may receive electrical wire 66 therethrough, that are coupled together mechanically, while also permitting relative lateral rotation. Referring to FIGS. 3, 5 and 6, in FIG. 3 the arm 60 is shown in a first lateral position 70*a*, which is also referred to as a first installed configuration of the light fixture. In FIG. 5 the arm 60 is shown in a second lateral position 70*b*, for example, rotated laterally about 90 degrees in a first lateral direction about the Z-axis, which may be perpendicular to the X-axis, from that of the first lateral position 70*a*. According to this configuration, which is also referred to as a second installed configuration, the orientation of the light housing 42 remains the same, but the arm 60 is rotated in a first lateral direction about the Z-axis from the first lateral position 70*a* to the second lateral position 70*b*. In FIG. 6, the arm 60 is shown in a third lateral position 70*c*, for example, rotated laterally about 90 degrees in a second lateral direction about the Z-axis from that of the first lateral position 70*a*, which is also about 180 degrees from that of the second lateral position 70*b*. That is, in this configuration, which is also referred to as a third installed configuration, the orientation of the light housing 42 remains at the same desired orientation, but the arm 60 is rotated in a second lateral direction about the Z-axis from the first lateral position 70*a* to the third lateral position 70*c*. As stated above, additional and/or alternative mechanical structures known in the art may be used to couple the arm 60 with the light housing 42 and also permit the elevational and lateral rotation described herein.

Thus, during an installation of the light fixture 40 in an area having limited, or tight, ceiling space and/or through the minimally sized installation hole 23, the rotational coupling 50 between the light housing 42 and the arm 60 may facilitate desirable repositioning of the light fixture 40. That is, for example, the arm 60 may be rotated, or pivoted, upward, as described herein, such that the arm 60, and other components of the light fixture 40, may be more easily advanced through the installation hole 23. Additionally, or alternatively, the arm 60 may rotated, or pivoted, sideways, as described herein, such that the arm 60 may be repositioned to avoid obstacles, while also maintaining a desired orientation of the light housing 42.

Figure 8:
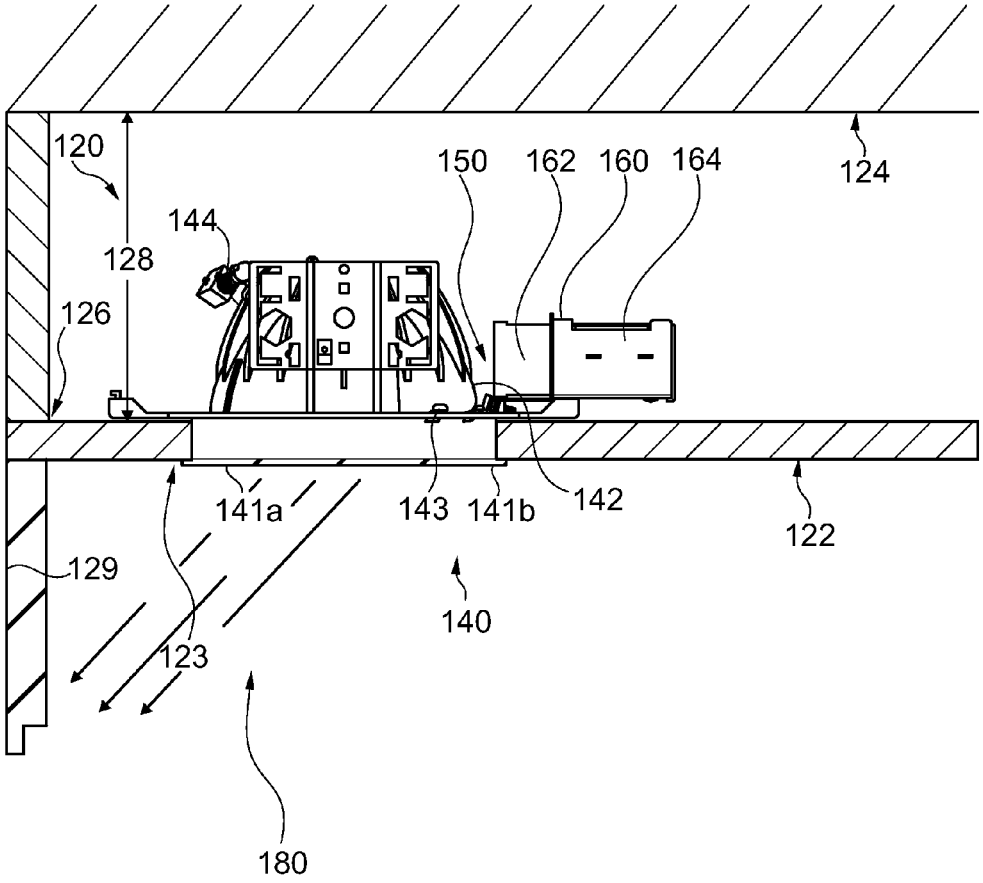
FIG. 8 is a side view of a second embodiment of a light fixture mounted in a ceiling, according to the present disclosure.

The teachings of the present disclosure are also applicable to a variety of alternative light fixtures. For example, turning now to FIG. 8, an alternative embodiment of a light fixture 140 according to the present disclosure is shown installed in a ceiling 120. In particular, the light fixture 140 may be installed in an installation hole 123 through a ceiling structure, such as a lower ceiling structure, 122. Clearance depth 128 above the ceiling structure 122 may be limited by another structure, such as an upper ceiling structure 124. Joists 126 and/or other obstacles may provide lateral space restrictions between the upper and lower ceiling structures 124 and 122. The light fixture 140 may generally include a light housing 142, a rotational coupling 150, and an arm 160. The arm 160 may include and/or support one or both of a driver 162, for example an LED driver, and an electrical junction box 164, and may include additional and/or alternative features for supplying electrical power to the light fixture 140 in a known manner. As is shown, the arm 160 may extend from a lower end 143 of the light housing 142; however, the arm 160 could alternatively extend from an upper end 144 of the light housing 142 or from some point in between the upper end 144 and the lower end 143.

The illustrative embodiment of the light fixture 140 is a downlight or, more specifically, a wallwasher type of recessed light, meaning that downward directed light 180 produced by the light fixture 140 is directed toward a first side 141*a* of the light housing 142, for example, so that it will illuminate a wall 129 located adjacent the installation hole 123 for the light fixture 140. In the illustrative embodiment of the light fixture 140, the arm 160 extends from a second side 141*b* of the light housing 142, opposite the first side 141*a* toward which the light 180 is directed. Since the light fixture 140 is a recessed downlight, such as a wallwasher, the orientation of the light housing 142 is critical and the light housing 142 should not be rotated to avoid obstacles. The rotational coupling 150, similar to the rotational coupling 50 described above, may permit elevational articulation and lateral rotation, as described above, which may be advantageous in installation of the light fixture 140, particularly when used for retrofitting or remodeling, especially in a minimally sized installation hole 123 and with limited space available above the lower ceiling structure 122.

While the invention has been illustrated and described in detail in the foregoing drawings and description, the same is to be considered as illustrative and not restrictive in character, it being understood that only illustrative embodiments thereof have been shown and described and that all equivalents and all changes and modifications known in the art that come within the spirit and scope of the invention as defined herein are desired to be protected.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A light fixture for recessed lighting installation, comprising:

a recessed light housing supporting a light source;

an arm extending from a first side of the recessed light housing and supporting a power supply for the light source;

a lateral pivot rotationally coupling the arm and the recessed light housing at a first axis; and an elevational pivot rotationally coupling the arm and the recessed light housing at a second axis.

2. The light fixture of claim 1, wherein the recessed light housing includes a reflector configured to direct light from the light source downward and toward a second side of the recessed light housing, wherein the second side of the recessed light housing is opposite the first side of the recessed light housing.

3. The light fixture of claim 2, wherein the light source includes one or more light emitting diodes.

4. The light fixture of claim 2, wherein the arm includes a driver for supplying power to the light source.

5. The light fixture of claim 4, wherein the arm also includes an electrical junction box.

6. The light fixture of claim 4, wherein the first axis is substantially perpendicular to the second axis.

7. The light fixture of claim 6, wherein the light fixture includes an installation configuration in which the arm is oriented along the first axis.

8. The light fixture of claim 6, wherein the light fixture includes:

a first installed configuration in which the recessed light housing has a desired orientation and the arm has a first lateral position;

a second installed configuration in which the recessed light housing has the desired orientation and the arm is rotated laterally about 90 degrees from the first lateral position in a first lateral direction about the first axis to a second lateral position; and a third installed configuration in which the recessed light housing has the desired orientation and the arm is rotated laterally about 90 degrees from the first lateral position in a second lateral direction, opposite the first lateral direction, about the first axis to a third lateral position.

9. The light fixture of claim 4, wherein the arm extends from an upper end of the recessed light housing.

10. The light fixture of claim 4, wherein a rotational coupling that provides the lateral pivot and the elevational pivot includes: a bracket coupled to the recessed light housing; a tongue coupled to the arm; and a coupler coupling the bracket with the tongue.

11. The light fixture of claim 10, wherein the elevational pivot is defined, at least in part, by a hinge at an interface between the coupler and the tongue.

12. The light fixture of claim 10, wherein the lateral pivot is defined, at least in part, by a rotationally free eyelet at an interface between the coupler and the bracket.

13. The light fixture of claim 8, wherein an electrical wire electrically connecting the driver with the light source passes through at least one of the tongue, the coupler, and the bracket.

14. A wallwasher light fixture, comprising:

a recessed light housing supporting a light source;

an arm extending from a first side of the recessed light housing and supporting a driver for the light source;

a lateral pivot rotationally coupling the arm and the recessed light housing at a first axis; and an elevational pivot rotationally coupling the arm and the recessed light housing at a second axis, wherein the second axis is substantially perpendicular to the first axis.

15. The wallwasher light fixture of claim 14, wherein the recessed light housing includes a reflector configured to direct light from the light source downward and toward a second side of the recessed light housing, wherein the second side of the recessed light housing is opposite the first side of the recessed light housing.

16. The wallwasher light fixture of claim 15, wherein the light source includes one or more light emitting diodes.

* * * * *